US008833403B2

(12) United States Patent
Le Costaouec

(10) Patent No.: US 8,833,403 B2
(45) Date of Patent: Sep. 16, 2014

(54) WEAVING WITH RETRACTABLE FINGERS

(71) Applicant: Hamilton Sundstrand Corporation, Windsor Locks, CT (US)

(72) Inventor: Jean-Francois Le Costaouec, Pueblo West, CO (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 15 days.

(21) Appl. No.: 13/721,730

(22) Filed: Dec. 20, 2012

(65) Prior Publication Data

US 2014/0150920 A1 Jun. 5, 2014

Related U.S. Application Data

(63) Continuation-in-part of application No. 13/706,168, filed on Dec. 5, 2012.

(51) Int. Cl.

| | |
|---|---|
| ***D03D 47/42*** | (2006.01) |
| ***D03D 47/02*** | (2006.01) |
| ***D03D 13/00*** | (2006.01) |
| *D03D 47/40* | (2006.01) |

(52) U.S. Cl.

CPC ..... *D03D 13/00* (2013.01); *D03D 47/02* (2013.01); *D03D 47/42* (2013.01)

USPC ..... 139/431; 139/195; 139/384 R; 66/11

(58) Field of Classification Search

None

See application file for complete search history.

(56) References Cited

U.S. PATENT DOCUMENTS

| | | | | | |
|---|---|---|---|---|---|
| 1,728,357 | A | | 11/1929 | Muheim | |
| 2,625,959 | A | * | 1/1953 | Turner | 139/431 |
| 3,752,195 | A | * | 8/1973 | Libby | 139/431 |
| 3,929,170 | A | * | 12/1975 | Muller | 139/430 |
| 3,973,597 | A | * | 8/1976 | Gardella | 139/431 |
| 3,978,895 | A | * | 9/1976 | Murasaki | 139/431 |
| 4,183,232 | A | * | 1/1980 | Banos et al. | 66/11 |
| 4,187,932 | A | | 2/1980 | Zarembka | |
| 4,657,051 | A | | 4/1987 | Speich | |
| 4,724,872 | A | | 2/1988 | Speich | |

(Continued)

FOREIGN PATENT DOCUMENTS

| | | | |
|---|---|---|---|
| DE | 2460737 | A1 | 8/1975 |
| FR | 2414087 | A1 | 8/1979 |
| JP | S5673138 | A | 6/1981 |
| WO | WO03089703 | A1 | 10/2003 |

OTHER PUBLICATIONS

Extended European Search Report, dated Mar. 17, 2014, for European Patent Application No. 13194836.6, 7 pages.

*Primary Examiner* — Bobby Muromoto, Jr.

(74) *Attorney, Agent, or Firm* — Kinney & Lange, P.A.

(57) ABSTRACT

A method of weaving a spiral-shaped textile includes inserting in the vicinity of the fell of the textile a finger adjacent to a first intermediate warp fiber between a first edge and a second edge; forming a loop around the finger with the weft fiber; wrapping weft fiber around the first intermediate warp fiber between the first edge and the second edge of the textile to secure the weft fiber in a radial direction between the first edge and the second edge of the textile; extending the weft fiber to the first edge of the textile; securing the weft fiber using a knitting system on the first edge of the textile; and removing the finger from the textile.

17 Claims, 4 Drawing Sheets

(56) References Cited

U.S. PATENT DOCUMENTS

| | | | | |
|---|---|---|---|---|
| 5,242,745 | A | 9/1993 | Aucagne et al. | |
| 5,454,403 | A | 10/1995 | Kerr et al. | |
| 5,617,902 | A | 4/1997 | Farley | |
| 6,308,808 | B1 | 10/2001 | Krenkel et al. | |
| 7,231,943 | B2 | 6/2007 | Svensson | |
| 7,451,787 | B2 * | 11/2008 | Speich | 139/22 |
| 7,743,794 | B2 * | 6/2010 | Berger | 139/22 |
| 8,066,034 | B2 * | 11/2011 | Berger | 139/22 |
| 8,074,330 | B2 | 12/2011 | Lescostaouec | |
| 2011/0275266 | A1 | 11/2011 | Lecostaouec | |

* cited by examiner

WEAVING WITH RETRACTABLE FINGERS

CROSS-REFERENCE TO RELATED APPLICATION(S)

This application is a continuation-in-part of co-pending U.S. application Ser. No. 13/706,168, titles SPIRAL TEXTILE AND SYSTEM FOR WEAVING THE SAME, filed on Dec. 5, 2012, which is hereby incorporated by reference.

BACKGROUND

Carbon/carbon ("C/C") parts are employed in various industries. An exemplary use for C/C parts includes using them as friction disks in aircraft brake disks, race car brake disks, clutch disks, and the like. C/C brake disks are especially useful in such applications because of the superior high temperature characteristics of C/C material. In particular, the C/C material used in C/C parts is a good conductor of heat, and thus, is able to dissipate heat away from the braking surfaces that is generated in response to braking. C/C material is also highly resistant to heat damage, and is capable of sustaining friction between brake surfaces during severe braking, without a significant reduction in the friction coefficient or mechanical failure.

Today's prevalent commercial approach to prepare fibrous preform structures for manufacturing carbon-carbon brake disks is to needle-punch layers of OPF PAN fibers in a board shape from which donut shape preforms are cut. The preforms are subsequently subjected to a costly carbonization cycle to transform the fiber into carbon. This approach yields a large amount of fiber waste. A more effective method to fabricate the fibrous preform structure is to organize carbonized fibers with a suitable fiber architecture in a continuous handleable spiral shape fabric. The carbon fiber narrow fabric is subsequently fed into a circular needle punch machine to prepare a three dimensional textile.

Various technologies exist for fabricating a continuous spiral fabric by modifying a conventional weaving loom such as a rapier or shuttle loom. Conical take-off rollers are used to control the take-up advance of the various warp yarns to form the specific geometry of the spiral fabric.

In weaving, it is desirable to form a fiber architecture that has a reasonably homogeneous fiber content across the fabric width to facilitate further processing and to yield suitable composite properties. Additionally, a reasonably consistent thickness of the fabric across the textile width is desirable during needle punching. In the case of a carbon brake disk application, it may be desirable to obtain a higher ratio of radial to circumferential reinforcement to draw out heat along the radial direction, thus a fabric with a higher weft to warp fiber content may be desirable. Holes or gaps in a textile may have a negative impact on thermo-mechanical and friction properties of the final brake material.

SUMMARY

A method of weaving a spiral-shaped textile includes inserting in the vicinity of the fell of the textile a finger adjacent to a first intermediate warp fiber between a first edge and a second edge; forming a loop around the finger with the weft fiber; wrapping weft fiber around the first intermediate warp fiber between the first edge and the second edge of the textile to secure the weft fiber in a radial direction between the first edge and the second edge of the textile; extending the weft fiber to the first edge of the textile; securing the weft fiber using a knitting system on the first edge of the textile; and removing the finger from the textile.

A spiral-shaped woven textile with a first edge and a second edge includes a single weft yarn extending varying distances from the first edge to the second edge so that some loops are secured to the second edge and some loops are secured to one or more intermediate warp yarns at locations between the first edge and the second edge so that no holes are present in the woven textile.

DETAILED DESCRIPTION

Figure 1:
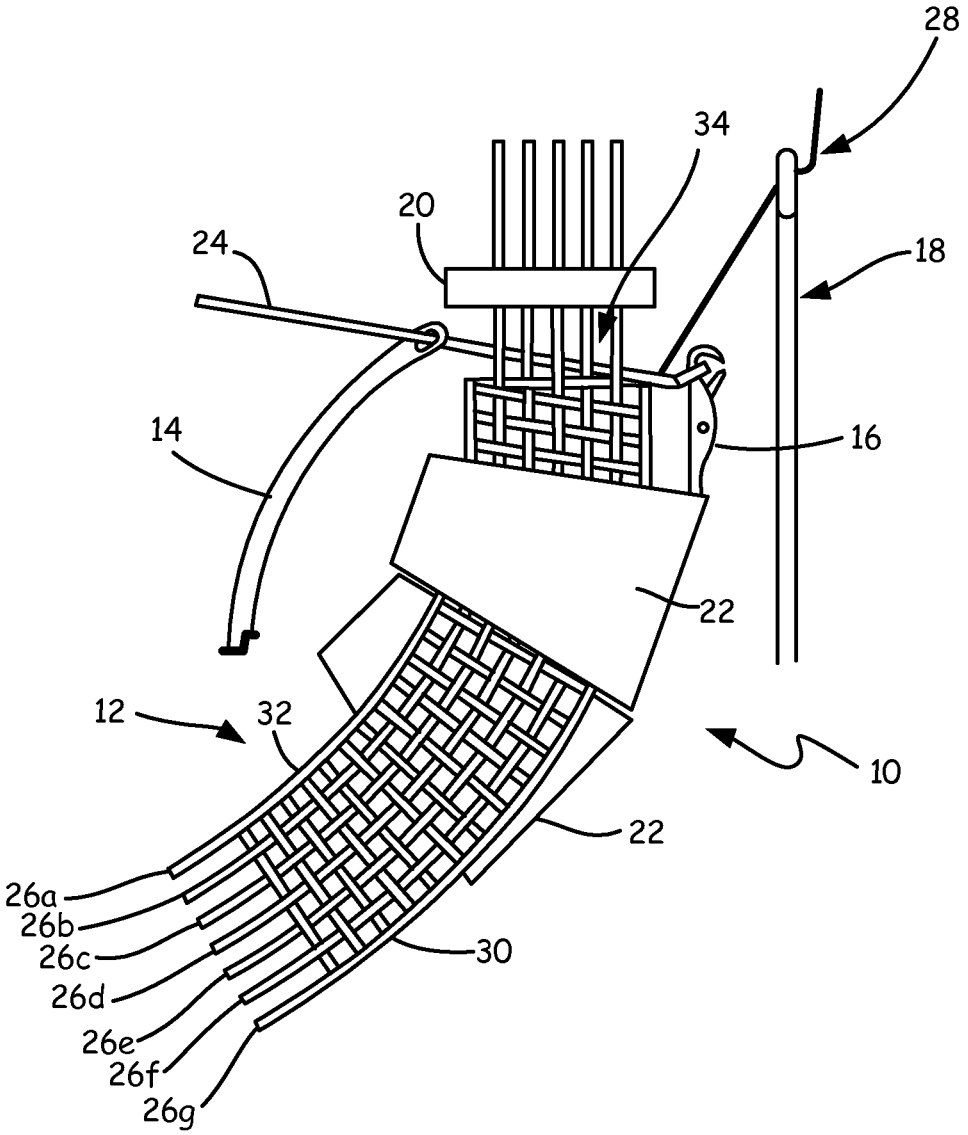
FIG. 1 is a perspective view of a portion of a helical textile weaving system.

This invention is generally related methods, apparatus and manufacturing associated with a spiral textile, and more particularly, to methods of weaving a spiral textile having a uniform radial fiber content and/or a higher radial fiber content along the outside perimeter of the textile and free of holes of significant size through use of one or more retractable fingers during the weaving process. A preferred method for efficiently manufacturing a shaped textile with two selvedge edges and a tailorable fiber architecture, as described in U.S. application Ser. No. 13/706,168, titles SPIRAL TEXTILE AND SYSTEM FOR WEAVING THE SAME, is through the use of a modified narrow fabric needle loom. As mentioned above, holes or gaps in a textile may have a negative impact on thermo-mechanical and friction properties of a final brake material. While these flaws have minimal impact for high areal weight fabrics, as greater tension may be applied to the warp yarns and high warp fiber density limit warp yarns lateral movement, it becomes critical to mitigate the formation of these flaws when low areal weight fabrics are being pursued.

As used herein the terms "tow" and "cable" are used to refer to a strand of substantially continuous filaments. "Spiral" fabric may also be referred to herein as "helical" fabric. A "textile" may be referred to as a "fabric" or a "tape." "Circular needle loom" may be used to identify or describe a "circular needle punching loom." A "fabric needle loom" or "tape needle loom" may be used to identify or describe a "narrow fabric needle loom or needle weaving machine."

As used herein, the term "yarn" is used to refer to a strand of substantially continuous fibers or staple fibers or blends of these; thus the term "yarn" encompasses tow and cable. For example, a "heavy tow" may comprise about 50,000 (50 K) textile fibers in a single tow, whereas a "lighter tow" may comprise about 12,000 (12 K) textile fibers within a single tow. Fewer or greater amounts of textile fibers may be used per cable in various embodiments. In various embodiments disclosed herein, weaving is performed using tows comprising 6 K or more textile fibers in a single tow, for example, 12

K, 24 K, 48 K, 50 K, and heavier tows. As is understood, "warp fiber" or "warp fibers" are fibers that lie in the "warp" direction in the textile—i.e., along the length of the textile. "Weft fiber" or "weft fibers" are fibers that lie in the "weft" direction in the textile—i.e., along the width of the textile. Warp fibers may be described as being spaced apart with respect to the weft direction (i.e., spaced apart between the OD and ID of the textile). Similarly, the weft fibers may be described as being spaced apart with respect to the warp direction.

In accordance with various embodiments, the term weft fiber is used to describe a portion of the continuous weft yarn within the fabric. The weft needle of narrow fabric needle loom may introduce a series of yarn loops through specific warp yarn sheds. The first and subsequent loops are logically defined by the point of entry and exit of the needle. This definition is applicable as the weft yarn is typically of a constant width throughout the fabric. In various embodiments having weft yarns of varied length, the weft fiber may be defined as originating from and terminating at a chosen reference, for example, the first edge, second edge or knitted edge of the fabric. A weft fiber may constitute a portion of weft yarn containing two primary half loops held at a first edge and one secondary loop held at some intermediate point between the first edge and the second edge. In order to describe the unique fiber architectures of the fabrics achieved with the various embodiments, the term pick is used to describe the weft filling for one weft needle insertion.

In accordance with various embodiments the outer and inner circumferences of the spiral fabric may be respectively referred to as first edge, knitted edge side and second edge, needle entry side or woven edge. In accordance with various embodiments, a spiral textile tape is configured to include weft fiber of varying lengths to facilitate obtaining a substantially homogeneous fiber volume, content and/or density.

FIG. 1 is a perspective view of a portion of a helical textile weaving system weaving helical textile 12. Weaving system includes narrow fabric needle loom 10 with weft needle 14, latch needle 16, binder thread inserter 18, reed 20 and conical rollers 22. Helical textile 12 is formed from weft yarn 24, warp yarns 26*a*-26*g* and binder thread 28; and includes first edge 30, second edge 32 and fell 34.

A shed is formed by arranging warp yarns 26*a*-26*g* either below or above where weft yarn 24 will weave through with weft needle 14. The area through which weft yarn 24 moves is called the shed.

Weft needle 14 connects to weft yarn 24 and pulls out weft yarn 24 from a stationary bobbin and/or spool or automated weft yarn feeder (not shown). Weft needle 14 then carries weft yarn 24 through a shed to second side 32 side of the textile 12. Upon arrival of the end of weft needle 14 to its fixed travel position, the primary loop formed by weft yarn 24 is secured in place by a binder thread 28 controlled by a binder thread inserter 18 and a latch needle 16. Weft yarn 24 is held in place by binder thread 28 while weft needle 14 travels back through the shed to its starting position, thus leaving two weft yarns 24 in the shed. Reed 20 beats-up the two segments of the weft yarn against the fell 34 of textile 12, and the previous steps are repeated. This results in pairs of weft fiber of identical or of different lengths within a shed depending on the definition of the various sheds.

When weaving helical textile 12, it may be desirable to achieve a substantially uniform fiber density and/or radial fiber content throughout textile 12. As mentioned above, spiral-shaped textiles of the prior art generally exhibit a reduced density of weft fiber at the outside diameter ("OD") of the spiral textile, as compared to the inside diameter ("ID"), due to the same number of weft fiber being distributed across an OD with a larger circumference than the ID. This reduced density at the OD may be referred to as a "deficiency" in the weft fiber density at the OD, or a lower radial fiber content at the OD than at the ID.

To address such a deficiency, needle loom 10 may tailor weft yarn 24 content across textile 12. This can be done by designing sheds and shed sequences so that weft yarn 24 wraps around an intermediate warp yarn (instead of a warp yarn at second edge 32) as weft needle is driven towards first edge 30, binding weft yarn 24 at first edge 30. Thus, weft fiber 24 of different lengths may originate from the first edge 30 or outside diameter ("OD") of spiral textile 12, with only some of the weft fiber 24 extending to the second edge 32 or inside diameter ("ID") of the spiral textile 12. Accordingly, the weft fiber density and/or radial fiber content can be configured to remain substantially uniform (constant) between the textile OD and the textile ID. It is especially desirable to maintain a substantially homogeneous fiber volume and/or content across a textile, which in turn results in a substantially uniform fiber density, radial fiber content, and/or fiber spacing, where the textile may be utilized as a friction surface, for example, in a brake disk.

When weft yarn 24 loops around an intermediate warp yarn, for example 26*c*, weft yarn 24 can pull on warp yarn 26*c* as it is brought back to first edge 30 to be bound with binder yarn 28 by knitting system. This pull can result in significant gaps between yarn 26*c* and the adjacent warp yarn in textile. As mentioned above, it is desirable to have a uniform textile with good fiber coverage in order to achieve optimum mechanical and friction performance in the final composite, and any holes of significant size could cause composite to wear and/or fail faster.

Figure 2A:
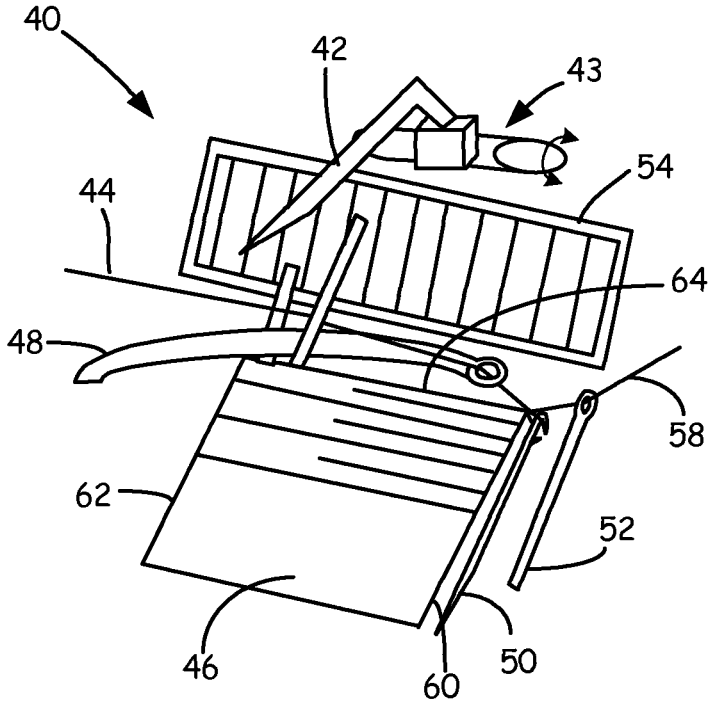
FIG. 2A is a perspective view of a portion of a helical textile weaving system with a retractable finger in an up position.
Figure 2B:
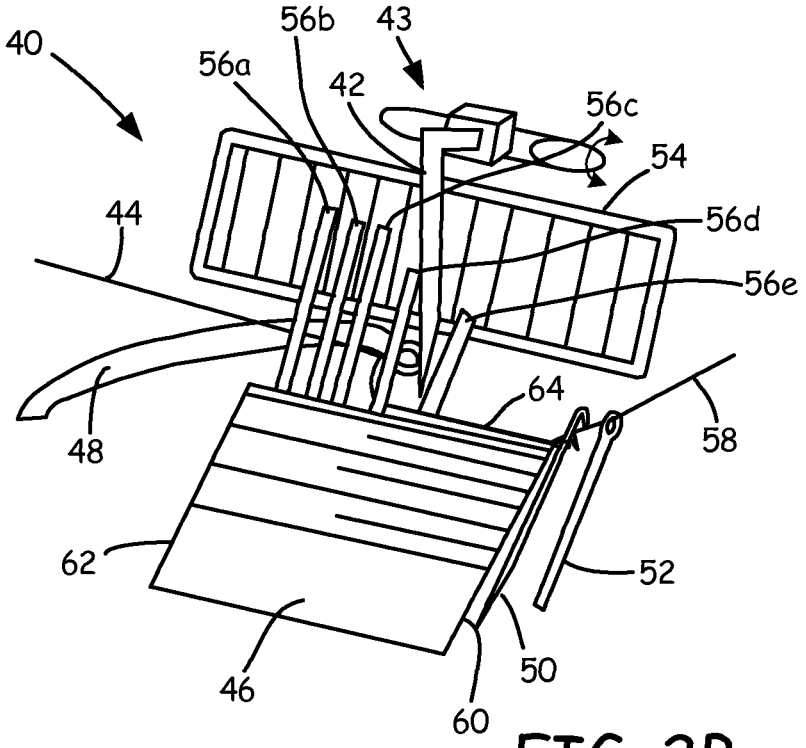
FIG. 2B is a perspective view of FIG. 2A with the finger in a down position.
Figure 2C:
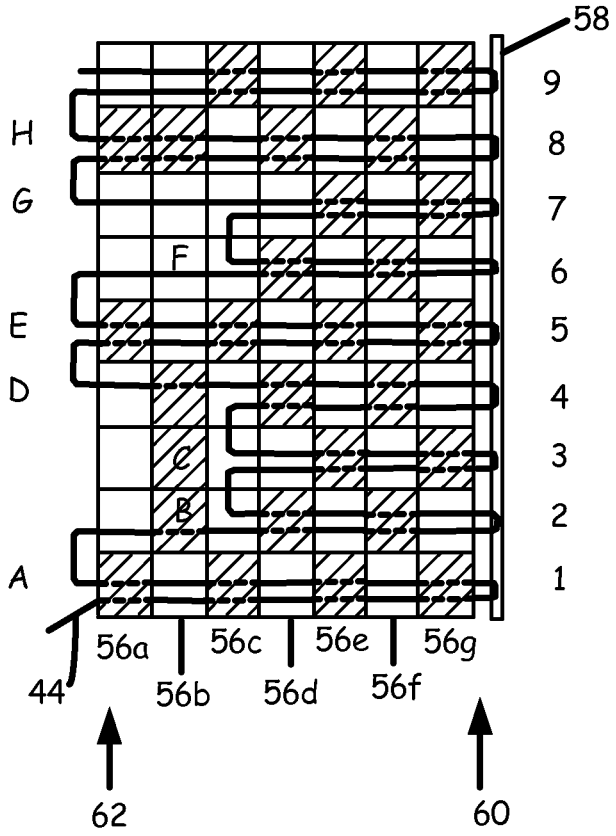
FIG. 2C is a close-up portion of a spiral textile woven by the system of FIGS. 2A-2B.

FIG. 2A is a perspective view of a portion of a helical textile weaving system 40 which includes finger 42 to weave weft yarn 44 to intermediate positions while eliminating the pull on intermediate warp yarns, resulting in a helical textile without the holes discussed above. FIG. 2A shows finger 42 in an up position. FIG. 2B is a perspective view of weaving system 40 with finger 42 inserted into the textile 46 to take tension off an intermediate length warp yarn. FIG. 2C shows a close-up portion of spiral textile 46, showing the path of weft yarn 44 for the first nine picks (picks numbered to the right of textile 46) and the locations of the various loops A-H formed by weft yarn 44 with seven warp yarns 56*a*-56*g*.

Weaving system 40 includes finger 42 with support 43, weft needle 48, latch needle 50, binder thread inserter 52 and reed 54. Helical textile 46 is formed from weft yarn 44, warp yarns 56*a*-56*g* and binder thread 58; and includes first edge 60, second edge 62 and fell 64.

Finger 42 can be metallic with a pointed end to insert between two warp yarns in textile 46 with minimal disturbance of the warp yarns. Finger 42 movement into and out of textile 46 is through rotation, and support 43 may move finger 42 to different radial positions for insertion at any point between first edge 60 and second edge 62.

As shown in FIG. 2C, weft yarn 44 forms primary loops held by a knitted binder thread along the first edge 60, with the knots of binder thread 58 numbered 1 to 9. Weft yarn 44 forms woven weft yarn secondary loops A, D, E, G and H along the second edge 62 and loops B, C and F at intermediate warp yarn 56*d*. The rows of squares represent shed openings. The columns of squares show warp yarns 56*a*-56*g*. White squares are areas of the fabric where the warp yarn is below weft yarn 44. Grey squares are areas of the fabric where the warp yarn is above weft yarn 44.

Weaving system 40 operates much in the same way as loom 10 of FIG. 1, with weft needle 48 moving weft yarn 44 into and out of sheds to be bound at first edge 60 with binder thread 58, and reed 54 pushing the weft segments against fell 64. As shown in the first pick (FIG. 2C), weft yarn 44 can be moved through a shed, bound with binder thread 58 at first edge 60, and then pulled back to second edge 62 to loop around warp yarn 56*a* at second edge 62.

During the weaving process, when it is desirable to loop weft yarn 44 around an intermediate warp yarn, for example, at pick 3, finger 42 is lowered into position through rotation of support 43. This rotational movement places finger 42 in the vicinity of fell 64 adjacent the desired warp yarn, in this case warp yarn 56*d*. The weaving sequence can be described with the following steps. Upon completion of pick 2, reed 54 moves toward its backward position, and a new shed is formed. Weft needle 48 is inserted into the shed from second side 62 to first side 60. Finger 42 is activated, mechanically or electronically coordinated with the movement of weft needle 48 and reed 54. As weft needle 48 travels pass finger 42, the segment of weft yarn located between fell 64 of textile 46 and eyelet of weft needle 48 comes in contact with finger 42, forming a loop on one side of finger 42. The insertion of finger 42 removes tension from warp yarn 56*d* when weft yarn 44 is being looped around it. Once finger 42 is in place, as shown in FIG. 2B, weft yarn 44 may be looped around warp yarn 56*d* (loop C) and then brought to first edge 60 to be secured with binder thread 58. Once weft yarn 44 is secured at first edge 60, finger 42 may then be retracted by support 43 to be removed from textile 46 (as shown in FIG. 2A) to allow reed 54 to push weft segments against fell 64. When it is desirable to wrap weft yarn 44 around another intermediate warp yarn, finger 42 may be re-inserted adjacent the desired intermediate warp yarn.

As shown in FIG. 2C, the three intermediate weft yarn 44 loops B, C and F (as shown in FIG. 2C) of textile 46 are placed above warp yarn 56*c*. In alternate embodiments, the loops could be placed below warp yarn 56*c*. One segment of loops B, C and F is below warp yarn 56*d*, the remaining segment of the corresponding loop is located above warp yarn 56*d*. Sheds are shown through the various rows of grey and white squares. Full fabric width weft fiber lengths like 4D5 and 8H9 are achieved by alternating the shed position of warp yarn 56*a* along second edge 62 from one weft needle 48 insertion to the next. Partial length weft fiber like 2B3 and 6F7 are achieved by maintaining the shed position of the first three warp yarns 56*a*-56*c* along the second edge 62 from one weft needle insertion to the next. Warp yarn 56*d*, the first warp yarn from second edge 62 occupying an alternate shed position from one weft needle 48 insertion to the next, is the warp yarn used to keep the weft fiber at an intermediate length from the first edge 60.

Finger 42 acts to remove tension associated with looping weft yarn 44 around intermediate warp yarn 56*d*. This allows weaving system 40 with finger 42 to be able to weave helical textile 46 with intermediate weft yarn 44 loops without causing holes between warp yarns, as in past spiral weaving systems. Depending on the width of the fabric and the selected location of the intermediate weft fiber, it may be desirable to modify the radial position of finger 42 from first edge 60 to second edge 62. This adjustment may be accomplished manually or automatically. The ability to move radially from first edge 60 to second edge 62 of finger 42 also allows system 40 to include various intermediate length weft fiber 44 for more versatile weaving of textile 46. In other embodiments, several fingers 42 may be mounted on separate horizontal supports and individually controlled. Each finger 42 is assigned to the manipulation of a given intermediate weft fiber.

Figure 3A:
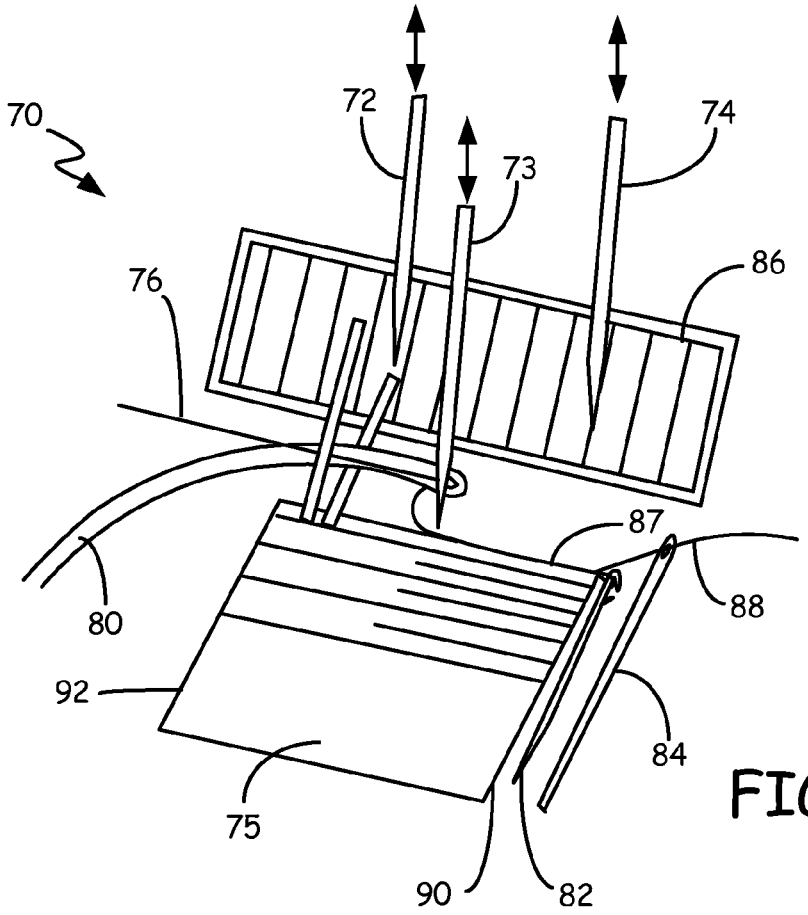
FIG. 3A is a perspective view of a portion of a second embodiment of a helical textile weaving system, using three fingers which move in a vertical direction.
Figure 3B:
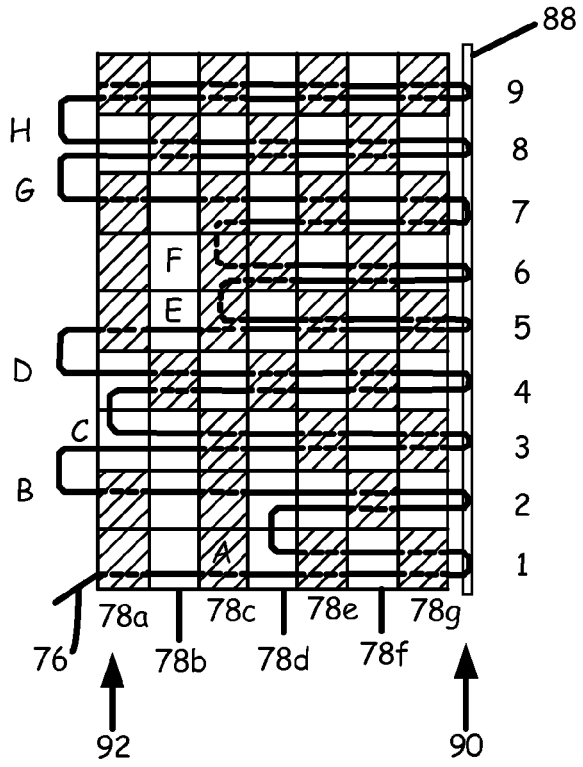
FIG. 3B is a portion of a spiral textile woven by system of FIG. 3A.

FIG. 3A is a second embodiment of a helical textile weaving system 70, with three fingers 72, 73 and 74, which move in a vertical direction for temporary insertion into textile 75. FIG. 3B shows a close-up portion of spiral textile 75, showing the path of weft yarn 66 for the first nine picks (picks numbered to the right of textile 64) and the locations of the various loops A-H formed by weft yarn 44 with seven warp yarns 78*a*-78*g*.

Weaving system 70 includes fingers 72, 73, 74 weft needle 80, latch needle 82, binder thread inserter 84 and reed 86. Fingers 72, 73 and 74 can be metallic, plastic or any other suitable material and may have a pointed end to insert into textile 75. Fingers 72, 73 and 74 may be mechanically or electronically controlled using a simple up and down movement. Fingers 72, 73 and 74 may be installed above or under the middle shed line. In the case of the above middle shed line configuration, the fingers are in working position in a down position. In the case of under the middle shed line, configuration of the fingers are in a working position in an up position. Helical textile 75 is formed from weft yarn 76, warp yarns 78*a*-78*g* and binder thread 88; and includes first edge 90 and second edge 90.

In the embodiment shown in FIG. 3A, weaving system 70 includes three fingers 72, 73 and 74 installed above middle shed line to move vertically into and out of textile 75 to remove tension from warp yarns during intermediate weaving loops. Fingers 72, 73 and 74 may be controlled by weaving system 70 and may be manually or automatically set along the radial direction of textile 75 between first edge 90 and second edge 92 to allow for insertion where intermediate loop is desired.

Finger 74 may be placed adjacent warp yarn 78*e* to remove tension from warp yarn 78*e* during formation of loop A by weft yarn 76. Finger 73 may then be retracted to allow reed 86 to push weft yarn 76 into fell 87. Subsequently, during picks where weft yarn 76 goes from first edge 90 to second edge 92, such as when forming loop B, fingers 72, 73 and 74 may be fully retracted, or in the up position. Finger 72 may then be inserted to remove tension from warp yarn 78*b* when weaving loop C, and retracted to allow reed 86 movement once weft yarn 76 is secured to knitted edge 90.

The use of three fingers 72, 73 and 74 may allow for a more efficient weaving process when multiple intermediate loops are desired, such as in textile 75, as shown in FIG. 3B. Finger 72, 73 and 74 can be quickly inserted to remove tension from an intermediate warp yarn during looping around it, and then can be quickly removed once weft yarn 76 has been secured with binder thread 88.

In summary, weaving systems 40, 70 use movable fingers 42, 72, 73, 74 to weave helical textile 46, 75 with intermediate weft yarn loops without causing holes in textile 46, 75. Finger 42, 72, 73, 74 movement is coordinated with movement of weft needle 48, 70; reed 54, 76 and other various parts of systems 40, 70 to temporarily insert fingers 42, 72, 73, 74 to remove tension from intermediate warp yarns when wrapping weft yarn around intermediate warp yarns. Fingers 42, 72, 73, 74 remain there only until weft yarn is secured to knitted edge, and then is quickly retracted to allow proper movements of reed 54, 86. By using one or more fingers which can be manually or automatically adjusted along the radial direction and insert or retract quickly to remove tension from intermediate warp yarns, weaving systems 40, 70 are able to efficiently weave spiral textiles which can vary weft fabric length in the radial direction without forming holes in finished textile.

While weaving system 40 includes one rotatable finger 42 and weaving system 70 includes three fingers 72, 73, 74, weaving systems can include any number of retractable fingers as desired. Weaving patterns as shown in FIGS. 2C and 3B are shown for example purposes only, and other embodiments could weave different patterns.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of weaving a spiral-shaped textile with a first edge and a second edge in a radial direction and a fell, the method comprising:

inserting in the vicinity of the fell of the textile a finger adjacent to a first intermediate warp fiber between the first edge and the second edge;

forming a loop around the finger with the weft fiber;

wrapping weft fiber around the first intermediate warp fiber between the first edge and the second edge of the textile to secure the weft fiber in a radial direction between the first edge and the second edge of the textile;

extending the weft fiber to the first edge of the textile;

securing the weft fiber using a knitting system on the first edge of the textile; and removing the finger from the textile.

2. The method of claim 1, and further comprising:

extending the weft fiber from the first edge of the textile to the second edge of the textile to wrap around warp fiber on the second edge of the textile; and extending the weft fiber from the second edge of the textile back to the first edge of the textile to secure the weft fiber to the first edge of the textile using a knitting system.

3. The method of claim 2, and further comprising:

reinserting in the vicinity of the fell of the textile the finger adjacent to a second intermediate warp fiber between the first edge and the second edge of the textile;

forming a loop around the finger with the weft fiber; and wrapping the weft fiber around the second intermediate warp fiber between the first edge and the second edge of the textile to secure the weft fiber in a radial direction between the first edge and the second edge of the textile.

4. The method of claim 1, wherein the weft fiber is wrapped around warp fiber using a weft needle extending from the first edge to the second edge of the textile.

5. The method of claim 1, and further comprising:

inserting one or more additional fingers adjacent to one or more additional warp fibers in the vicinity of the fell between the first edge and the second edge of the textile;

forming a loop around the one or more additional fingers with the weft fiber; and wrapping the weft fiber around the one or more additional intermediate warp fibers between the first edge and the second edge of the textile to secure the weft fiber in a radial direction between the first edge and the second edge of the textile, wherein the weft fiber is secured to the first edge between wrapping around each of the one or more additional intermediate warp fibers.

6. The method of claim 1, wherein the weft fiber extends in the radial direction of the textile in sheds.

7. The method of claim 1, wherein the weft fiber is secured at various intermediate positions between the first edge and the second edge of the textile.

8. The method of claim 1, wherein the finger has a pointed shape where it is inserted adjacent to a first intermediate warp fiber.

9. The method of claim 1, wherein the finger moves in a vertical motion.

10. The method of claim 1, wherein the finger moves in a rotational direction.

11. A method of weaving a helical textile comprising:

a) inserting in a first shed a weft yarn with a weft needle from the second side to the first side of the textile in the radial direction;

b) securing the weft yarn to the first side of the textile;

c) retracting the weft needle from the first side to the second side of the textile;

d) beating a fell of the textile with a reed;

e) creating a second shed;

f) inserting the weft needle into the second shed from the second side to the first side of the textile;

g) inserting a finger in the vicinity of the fell and adjacent to an intermediate warp yarn located between the first side and the second side;

h) looping the weft yarn around the finger to secure the weft yarn on the intermediate warp yarn;

i) securing the weft yarn to the first side of the textile;

j) removing the finger from the textile;

k) retracting the weft needle from the textile;

l) beating the fell of the textile with a reed;

m) creating a third shed;

n) inserting the weft needle into the third shed; and o) securing the weft yarn to the first side of the textile.

12. The method of claim 11, wherein steps a)-o) can be repeated.

13. The method of claim 11, and further comprising:

inserting one or more additional fingers to allow the weft yarn to loop around at an intermediate position between the first and second sides.

14. The method of claim 11, wherein steps g)-i) can be repeated at specific intervals between weaving weft yarns from the first side to second side to weave a helical textile without holes.

15. The method of claim 11, wherein step g) comprises:

moving a finger in the vertical direction adjacent to an intermediate warp yarn in the vicinity of the fell.

16. The method of claim 11, wherein step g) comprises:

rotating a finger to be located adjacent to an intermediate warp yarn in the vicinity of the fell.

17. The method of claim 11, wherein the finger has a pointed shape where it is inserted.

* * * * *